US005127156A

United States Patent [19]

Yokoyama et al.

[11] Patent Number: 5,127,156

[45] Date of Patent: Jul. 7, 1992

[54] METHOD FOR CONCENTRICALLY ASSEMBLING A PAIR OF CYLINDRICAL MEMBERS AND METHOD FOR ASSEMBLING A NOZZLE IN A FUEL INJECTOR

[75] Inventors: Mizuho Yokoyama; Hisanobu Kanamaru, both of Katsuta; Kenichi Gunji, Tsunesumi; Atsushi Koshizaka, Nakaminato, all of Japan

[73] Assignees: Hitachi, Ltd., Tokyo; Hitachi Automotive Engineering Co., Ltd., Ibaraki, both of Japan

[21] Appl. No.: 584,744

[22] Filed: Sep. 19, 1990

[30] Foreign Application Priority Data

Sep. 25, 1989 [JP] Japan ..... 1-248704

[51] Int. Cl.[5] ..... B21D 31/00

[52] U.S. Cl. ..... 29/890.143; 29/890.142; 29/506; 29/507; 29/522.1; 29/523

[58] Field of Search ..... 29/890.142, 890.143, 29/506, 507, 522.1, 523

[56] References Cited

U.S. PATENT DOCUMENTS

| | | | |
|---|---|---|---|
| 3,006,026 | 10/1961 | Martin et al. | 29/890.142 |
| 3,858,812 | 1/1975 | Williams et al. | 29/890.143 |
| 4,349,947 | 9/1982 | Rood | 29/890.143 |
| 4,389,766 | 6/1983 | Capuano | 29/522.1 |

FOREIGN PATENT DOCUMENTS

| | | |
|---|---|---|
| 140508 | 6/1983 | Japan . |
| 111280 | 11/1988 | Japan . |
| 2198589 | 6/1988 | United Kingdom . |

*Primary Examiner*—P. W. Echols
*Assistant Examiner*—David P. Bryant
*Attorney, Agent, or Firm*—Antonelli, Terry, Stout & Kraus

[57] ABSTRACT

An inner cylindrical component is disposed on a bottom portion of an outer cylindrical component with a clearance which is formed between an outer diameter portion of the inner component and an inner diameter portion of the outer component. A guiding pin for positioning is inserted concentrically through the inner component and a tip end portion of the guiding pin engages with the bottom portion of the outer component. An outer peripheral portion of the positioned inner component is locally and vertically pressure-pressed. A portion of the inner component is extended in an outer diameter direction according to the pressure-pressing plastic deformation. The extended member of the inner component is joined together with the inner diameter portion of the outer component. The extended member of the inner component and the outer component are mutually combined together. After the pressing operation the guiding pin is withdrawn.

9 Claims, 6 Drawing Sheets

FIG. 1(III)
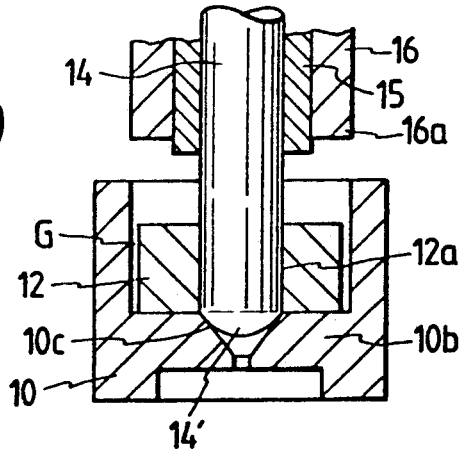

FIG. 4(III)
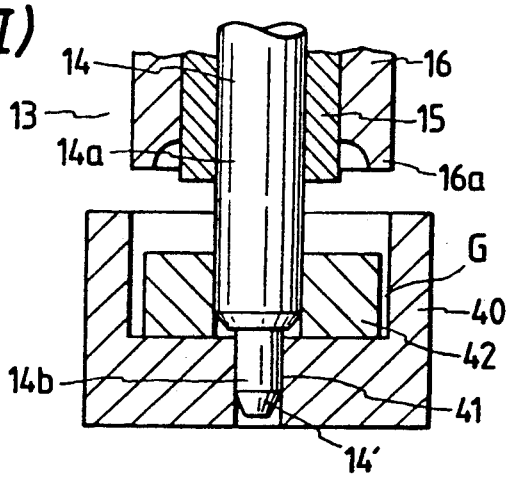

METHOD FOR CONCENTRICALLY ASSEMBLING A PAIR OF CYLINDRICAL MEMBERS AND METHOD FOR ASSEMBLING A NOZZLE IN A FUEL INJECTOR

BACKGROUND OF THE INVENTION:

The present invention relates to a method for assembling a plurality of concentrically disposed members such as, for example, members of a fuel injector nozzle and, more particularly, an electro-magnetic fuel injector for use in an automobile fuel supply system.

Generally, an electro-magnetic fuel injector includes a valve seat in an interior portion of a nozzle vane body fashioned as a cylindrical component, and a fuel passage, with the fuel passage being opened and closed by a valve movable toward and away from the valve seat by a linear reciprocating movement. The reciprocating movement of the movable valve is ordinarily caused by an energization of an electro-magnetic coil and a force of a return spring upon a de-energization of the coil.

For a guiding motion of the movable valve, a chip is fashioned as an inner cylindrical component in which an inner diameter portion thereof functions as a valve guiding member, the chip being disposed in the interior portion of the nozzle as described in, for example, Japanese Patent Laid-Open No. 140508/1983.

In, for example, Japanese Patent Laid-Open No. 140508/1983, a nozzle assembly is provided which includes a tapering face formed in an inner bottom portion of the nozzle main body or nozzle chip having an orifice. A valve guiding member, having a valve guiding hole, is inserted into the nozzle main body with one end of the valve guiding member contacting the tapering face of the nozzle main body. A holding member is inserted into the main nozzle so as to fix the valve guiding member in position. By virtue of the contact between the outer diameter of the valve guiding member and tapering inner bottom portion of the main body a concentric positioning between the inner bottom portion of the main body and the valve guiding hole is achieved.

In U.K. 2,198,589, an electro-magnetic fuel injector apparatus is proposed wherein two components are combined together utilizing a metal plastic deformation. In this proposed construction, a core and a yoke are concentrically disposed in a jig, and the core and yoke are joined through plastic deformation.

The utilization of metal plastic deformation for a fuel injector apparatus is also proposed in, for example, 20 Japanese Patent Laid-Open No. 111280/1988.

A disadvantage of the above discussed conventional techniques resides in the fact that, upon inserting the holding member, the inner cylindrical component is subjected to a rotational force due to contact between the holding member and the inner cylindrical component. By virtue of the imparting of the rotational force, an accurate concentric positioning is difficult to achieve.

By virtue of the difficulty achieving positioning accuracy, even when the movable valve body contacts the valve set in a valve closing state, a clearance may exist between the movable valve body and the valve seat resulting in leakage.

Further, during a valve opening, an imbalance results causing a circular clearance between the movable valve body and the valve seat, with such circular clearance resulting in an uneven fuel spray. Further, the reciprocating movement of the control rod of the movable valve guided by the valve guiding member cannot be carried out smoothly, and an abnormal abrasion of the control rod results thereby reducing the service life of the injector. Moreover, even when the holding member is threaded into the outer cylindrical component, fine ferrite powder may occur in the threaded portion, with the fine ferrite powder adhering to, for example, the valve seat or other components of the nozzle. The presence of ferrite powder between the valve seat and the movable valve body may result in leakage of the nozzle.

In the arrangement of U.K. 2,198,589, the core and the yoke are formed as open cylindrical members and the core is inserted into the yoke, with a positioning guide being passed from a side of the yoke as the outer side of the cylinder to a side of the core as the inner side cylinder, and then a punch is operated from the opposite position in a direction opposite an insertion direction of the positioning guide.

The arrangement of U.K. 2,198,589 is difficult to apply when the outer cylindrical component has a bottom portion since, when the inner cylindrical component is fitted to the outer cylindrical component having the bottom portion, by virtue of the existence of the bottom portion, it is difficult to insert a positioning guide pin into the inner cylindrical component from the side of the outer cylindrical component.

To accommodate the positioning pin, it has been proposed to provide a hole such as an orifice in the bottom portion of the outer cylindrical component, with a hole diameter of the outer cylindrical component being smaller than a hole diameter of the inner cylindrical component; however, this proposal does not ensure positional accuracy of the component of the injector.

SUMMARY OF THE INVENTION

The aim underlying the present invention essentially resides in providing a method for concentrically assembling two components in, for example, a fuel injection nozzle.

By virtue of the features of the present invention, it is possible to concentrically combine both an outer cylindrical component having a bottom portion such as a nozzle and an inner cylindrical component having a hole portion such as a valve guide by utilization of a plastic fluidity. Further, a positioning accuracy of the components can be improved, and it is possible to provide for an automation for assembly of the components.

Moreover, according to the invention, it is possible to avoid production of ferrite powder generated in conventional threaded couplings for combining the nozzle and valve guide of an injection nozzle.

The method of the present invention comprises the steps of securing a clearance between an inner diameter portion of an outer cylindrical component and an outer diameter portion of an inner cylindrical component, with the inner cylindrical component being fitted to an interior portion of the outer cylindrical component in a state wherein the inner cylindrical component is disposed on the bottom portion of the outer cylindrical component. In this state, into a hole of the inner cylindrical component, a guiding pin for positioning, having a diameter substantially the same as that of the hole and forming an inserting guiding face at an end tip, is inserted such that the pin tip end of the guiding pin contacts a tapering hole of the outer cylindrical component, and a temporary concentric positioning is carried out between the hole of the inner cylindrical component and the tapering hole of the outer cylindrical component. At a temporary positioning state, a punch is moved and guided in the same direction as an insertion direction of the guiding pin along an outer peripheral portion of the guiding pin, whereby a vicinity of a fitting portion of the inner cylindrical component is pressed by the punch to cause a local plastic fluidity, whereby the inner cylindrical component and the outer cylindrical component are combined due to a force of the plastic fluidity.

Further, the present invention provides a method for assembling a nozzle in a fuel injector, with a swirler being put into the nozzle main body, the method comprising the steps of securing a clearance between an inner diameter portion of the nozzle main body and an outer diameter portion of the swirler, with the swirler being fitted in an interior portion of the nozzle main body, and at this fitting state, in an inner diameter portion of the swirler, a guiding pin for positioning, having a diameter substantially the same as that of the inner diameter portion of the swirler and forming an inserting guiding face at an end tip, is inserted such that the pin tip end of the guiding pin contacts a valve seat of the nozzle main body. A temporary concentric positioning is carried out between the inner diameter portion of the swirler and the valve seat of the nozzle main body, and, at the temporary positioning state, by moving and guiding a punch in the same direction as an insertion direction of the guiding pin, a vicinity of a fitting portion of the swirler is pressed by the punch to cause a local plastic fluidity thereby combining or joining the swirler and fixing the same to the nozzle main body by a force of the plastic fluidity.

BRIEF DESCRIPTION OF THE DRAWINGS

FIGS. 5(*a*)-5(*d*) are comparative explanatory views of a concentric centering degree of a single component of an nozzle and a swirler in the first embodiment and a concentric centering degree after a combination or joining thereof, in which

DESCRIPTION OF THE INVENTION

Figure 3:
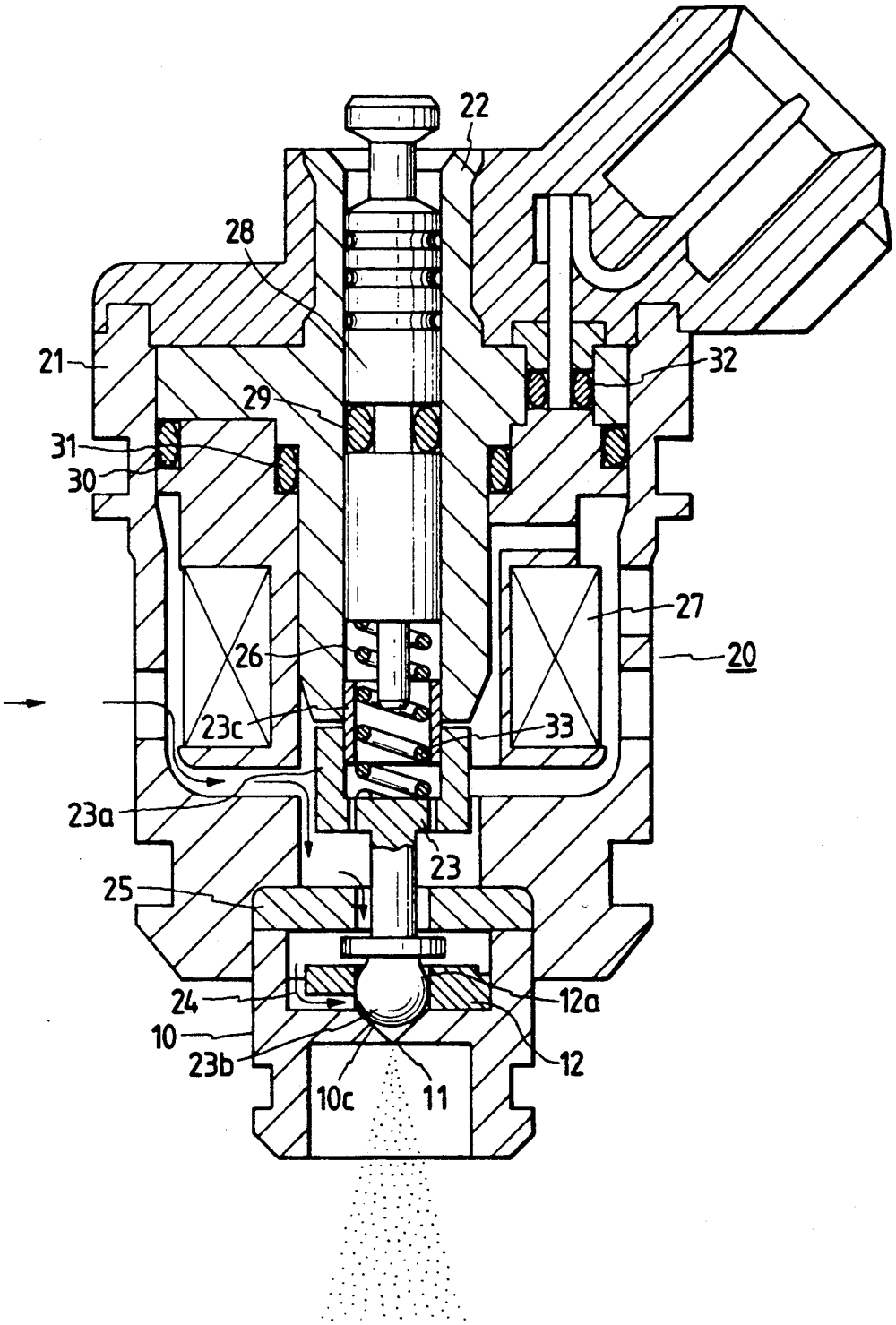
FIG. 3 is a longitudinal cross-sectional view of an electro-magnetic fuel injector constructed in accordance with the present invention.

Referring now to the drawings, wherein like reference numerals are used throughout the various views to designate like parts, and, more particularly, to FIG. 3, according to this figure, an electro-magnetic type fuel injector includes a main body 20 having a yoke 21 as an outer shell structure, with an electro-magnetic coil 27, a cylindrical core 22 and a movable valve 23 being installed in an inner portion of the yoke 21.

The movable valve 23 includes a plunger 23*a*, a ball valve 23*b* provided on one end thereof, and a guiding member 23*c* provided on an opposite end thereof, with the guiding member 23*c* being inserted into an inner diameter portion of the cylindrical core 22 via a return spring 33. A spring force of the return spring 33 is adjustable by an adjusting screw 28, with the spring force being sufficient to force the ball valve 23*b* into contact with a valve seat 10*c* of a nozzle 10.

Upon energization of the electro-magnetic coil 27, the cylindrical core 22, the yoke 21 and the plunger 23*a* form a magnetic circuit. When this magnetic circuit is formed, the ball 23*b* together with the plunger 23*a* is magnetically drawn against the force of the return spring 33. The ball valve 23 is separated from the valve seat 10*c* thereby opening an orifice 11 of the nozzle 10 so as to result in a fuel injection.

As indicated by the arrows in FIG. 3, fuel enters from a side face of the yoke 21 and passes through a clearance between the yoke 21 and the coil 27, the clearance between the yoke 21 and the movable valve 23, and, after passing through a swirler 12, is injected from a space between the ball valve 23*b* and the valve seat 10*c* through the orifice 11. When the electro-magnetic coil 27 is de-energized, the movable valve 23 is brought into contact with the valve seat 10*c* by the spring force of the spring 33. When the fuel injection is carried out employing the above stated method, the spring force imparted to the movable valve 23 is adjusted so as to provide a proscribed injection amount at a predetermined period and over a predetermined time.

The swirler 12 is positioned upstream of the valve seat 10*c*, with the swirler 12 being adapted to impart a swirling force to the fuel. The swirler 12 is formed as a circular member and includes a fuel passage groove 24 extending from an outer diameter portion at one side face thereof.

An outlet portion of the fuel passage groove 24 extends in a tangential direction of the inner diameter portion of the swirler 12. During the valve opening, the fuel arriving in the inner portion of the swirler 12 is swirled and flows from the inner portion of the swirler 12 to the valve seat 10*c*.

An inner portion 12*a* of the swirler 12 receives the ball valve 23*a* and functions for guiding a straight line reciprocating motion of the ball valve 23*b*.

The nozzle 10 is mounted on one end of the injector main body 20, with a stopper 25 for regulating movement of the movable valve 23 being disposed between the nozzle 10 and the main body 20.

Sealing members 29, 30, 31 and 32 are provided between the components for ensuring liquid tightness.

With the nozzle 10 and the swirler 12 installed in an inner portion of the nozzle 10, a nozzle 10 represents the outer cylindrical component, and the swirler 12 represents the inner cylindrical component.

Namely, the nozzle 10 forms a tapering shape valve seat or tapering hole 10*c* at an inner bottom portion thereof, and the inner diameter portion of the swirler 12 corresponds to the valve guiding hole 12*a*. The swirler 12 is concentrically and fixedly positioned on a surface of the inner bottom portion of the nozzle 10.

Figure 1I:
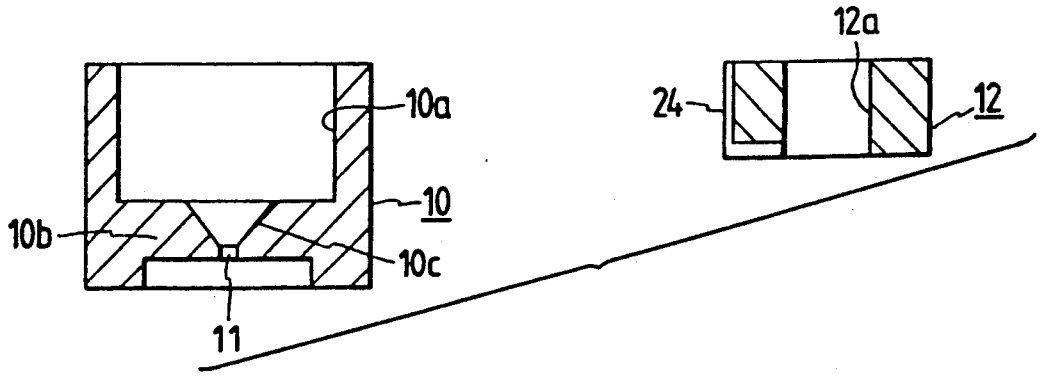
FIG. 1(I) is an exploded view of two components to be combined in accordance with one embodiment of a method according to the present invention.
Figure 1:
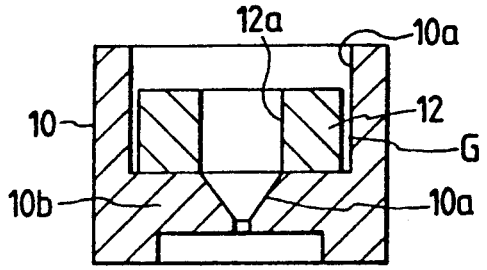
FIGS. 1(II)-1(IV) are schematic cross-sectional views illustrating the steps of the method according to the present invention.
Figure 1:
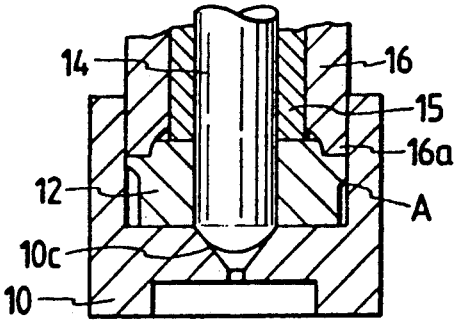

To assemble the nozzle 10, as shown in FIG. 1(I) and FIG. 1(II) the swirler 12 is inserted into the nozzle 10 with a clearance or gap G provided between the inner diameter portion and the outer diameter portion thereof. Next, as shown in FIG. 1(III), in the inner diameter portion 12*a* of the swirler 12, a pin tip 14' of a positioning pin 14 is pushed into contact with the valve seat 10*c* of the nozzle 10. The positioning pin 14 has substantially the same diameter as that of the inner diameter portion 12*a* of the swirler 12.

In this case, since the pin tip 14' has a round shape and is formed with an insertion guiding face, even the positioning pin 14 has substantially the same diameter as the inner diameter of the swirler 12. The positioning pin 14 can be guided by the guiding face of the tip thereof and can be inserted smoothly into the swirler diameter portion 12*a*. The pin tip 14' may be formed with a tapering shape in place of the round shape.

As the positioning pin 14 contacts the tapering shape valve seat 10*c* provided on the inner portion of the nozzle 10, the nozzle 10 and the swirler 12 are temporarily and concentrically positioned. This temporary positioning, at the stage shown in FIG. 1(II), enables a correction in any off-centering by virtue of the provision of the clearance or gap G.

Next, as shown in FIG. 1(IV), a mechanical and local pressing force is applied to the fitting portion periphery A of the swirler 12, and then the plastic fluidity is generated at this pressing portion.

With the state in which the positioning pin 14 is inserted into the swirler inner diameter portion 12*a*, the swirler 12 and the nozzle 10 are completely fixed by a holding member 15. Accordingly, mechanical pressing is carried out to press a vicinity of the swirler diameter portion through a projecting portion 16*a* provided on the tip of a punch 16 maintaining the above state.

Figure 2:
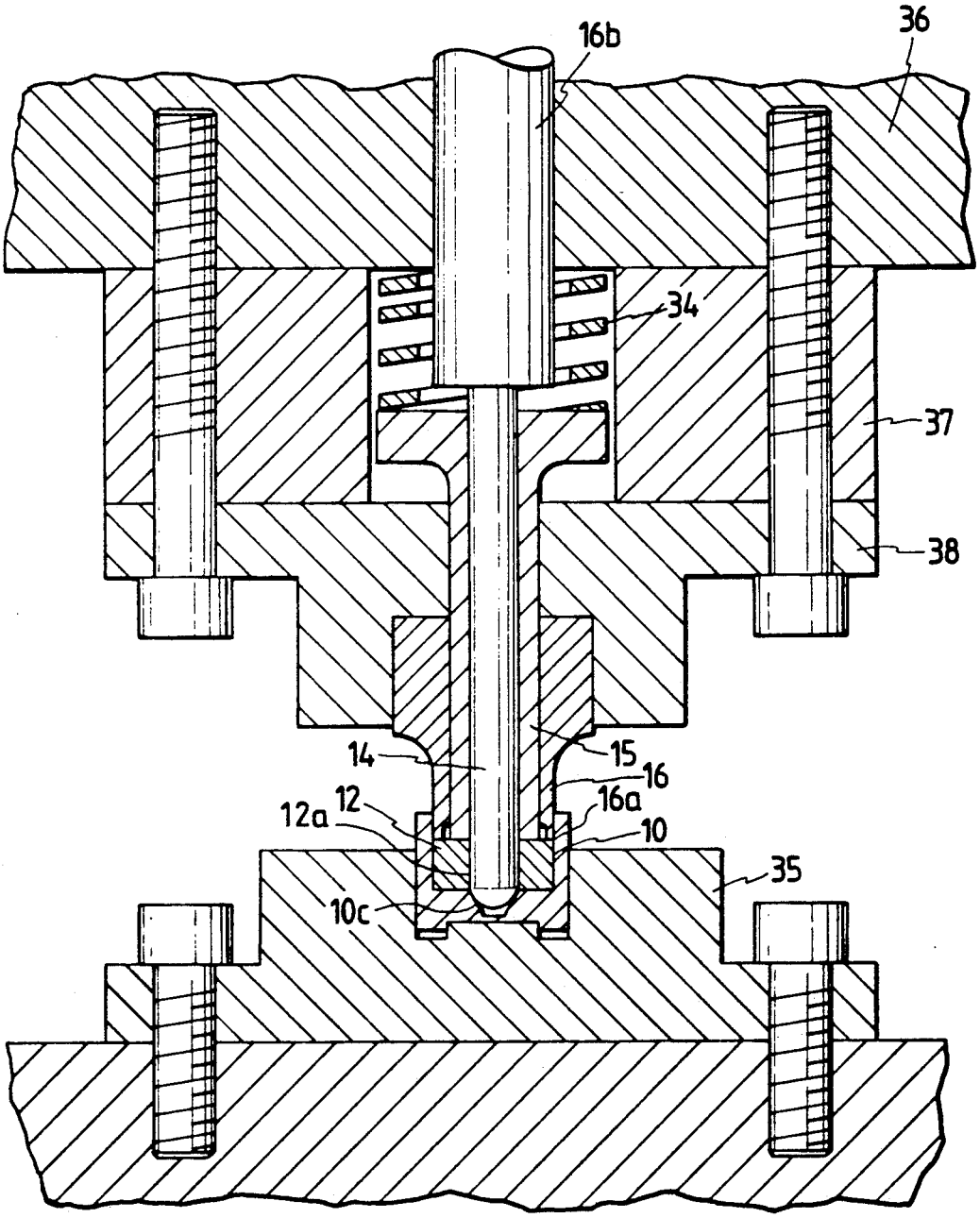
FIG. 2 is a cross-sectional view of a portion of a die mounted to a press for use in the first embodiment of FIG. 1.

As shown in FIG. 2, the nozzle 10 and swirler 12 are inserted and set into a die receiving member 35.

The positioning pin 14, the holding member 15, the punch 16, a sub-cylinder 16*b* and a holding spring 34 are mounted on a ram 36 of a press through a backing plate 37 and a punch holder 38. Within these components, the holding member 5 and the punch 16 are concentrically disposed at an outer peripheral portion of the position pin 14.

The positioning pin 14 is dropped or lowered using the sub-cylinder 16*b*, and the positioning pin 14 is pushed into the swirler inner diameter portion 12*a* so that the pin tip 14' contacts the valve seat 10*c* at a side of the nozzle 10. After the centering of the valve seat 10*c* and the swirler inner diameter portion 12*a* by the positioning pin 14, the ram 36 is displaced in a downward direction.

By the above stated process, the holding member 15 fixes the nozzle 10 and the swirler 12 by the force of the spring 34. In this state, the ram 36 is further lowered, and the punch 16 moves along the peripheral portion of the positioning pin 14, then the vertical pressing force is added in a vicinity A of the outer peripheral portion provided on the upper surface of the swirler 12 through the projecting portion 16*a* of the punch 16.

Accordingly, the plastic fluidity is generated in the pressing portion or the vicinity A, and the nozzle 10 and the swirler 12 are combined by acting on a tensional force and the shearing force through the plastic fluidity at side of the outer diameter of the nozzle 10. After the combination or joining is completed, the sub-cylinder 16*b* is raised, and the positioning pin is pulled out or withdrawn from a swirler 12. Subsequently, the ram 36 is raised, and the product is removed from the die.

According to this embodiment, when the swirler 12 is combined with the nozzle 10, using the press, the nozzle 10 and the swirler 12 can be combined automatically and integrally. Moreover, a good concentrical positioning accuracy after the combination between the valve seat 10*c* and the inner diameter portion 12*a* of the swirler 12 can be maintained.

In FIG. 5(*d*), the vertical axis represents a sampling number of the products, and the horizontal axis represents the concentric centering degree.

In FIG. 5(*d*), a line connecting black dots represents a sum ($\phi C1+\phi C2$) of the concentric centering degree $\phi C1$ of the valve seat 10*c* against the inner diameter of the nozzle 10 and the concentric centering degree $\phi C2$ of the swirler inner diameter 12*a* against the outer diameter of the swirler 12. The white dots represent concentric centering degree $\phi C$ of the swirler inner diameter 12*a* against the valve seat 10*c* after the combination or joining of the nozzle 10 and the swirler 12.

As apparent from FIGS. 5(*a*)–5(*d*), the concentric centering degree $\phi C$ after the combination is improved by an amount greater than the sum ($\phi C1+\phi C2$) of the single number concentric centering degree before the combination. Concretely, the main concentric centering degree X1 of the sum ($\phi C1+\phi C2$) of the single member concentric centering degree is 21.8 μm, but the main concentric centering degree X2 of the concentric centering degree $\phi C$ after the combination is 5.8 μm. Accordingly, the concentric centering degree $\phi C$ after the combination is about ¼ less as compared with the single member concentric centering degree ($\phi C1+\phi C2$).

Figure 6:
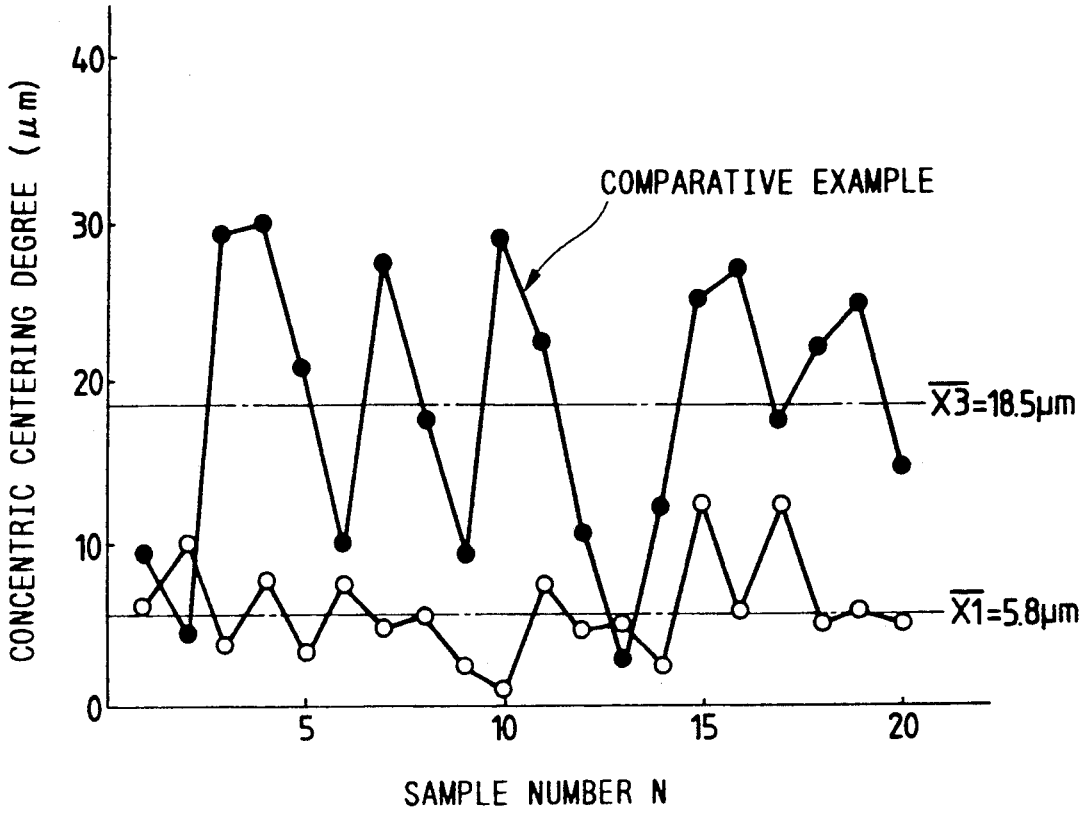
FIG. 6 is a graphical illustration of a comparison between a concentric centering degree of a combined nozzle and swirler in the first embodiment and a concentric centering degree of the comparative example with the nozzle end of the swirler being combined without using a positioning pin.

In FIG. 6, the vertical axis represents the sampling numbers of the products, and the horizontal axis represents the concentric centering degree.

As apparent from FIG. 6, in the comparative example without using the positioning pin 14, the mean concentric centering degree X3 between the valve seat of the nozzle and the swirler inner diameter is 18.5 μm, with the main concentric centering degree of the embodiment of the invention being 5.8 μm, and, consequently, the concentric centering degree can be improved by about ⅓ as compared with the comparative example not using the positioning pin 14.

Since the concentric degree accuracy can be improved as noted above, with the concentric combination member of the invention applied to the electromagnetic type fuel injector, the poor accuracy result with respect to the position of the valve guide or swirler inner diameter against the valve seat 10*c* can be eliminated.

As a result, during the valve opening, the contact for the valve body 23*b* against the valve seat 10*c* can be assured; therefore, the leakage can be prevented. Also, during the valve opening, the ring-shaped clearance between the valve seat 10*c* and the valve body 23*b* is uniform and, accordingly, the unevenness in the fuel spray can be avoided.

Furthermore, it is possible to smoothly guide the movable valve 23 disposed in the swirler 12, thereby avoiding abnormal abrasion of the components. Also, the presence of fine ferrite powder in the space between the valve seat and the valve body is eliminated; therefore, the reliability of the fuel injector can be increased.

Figure 4I:
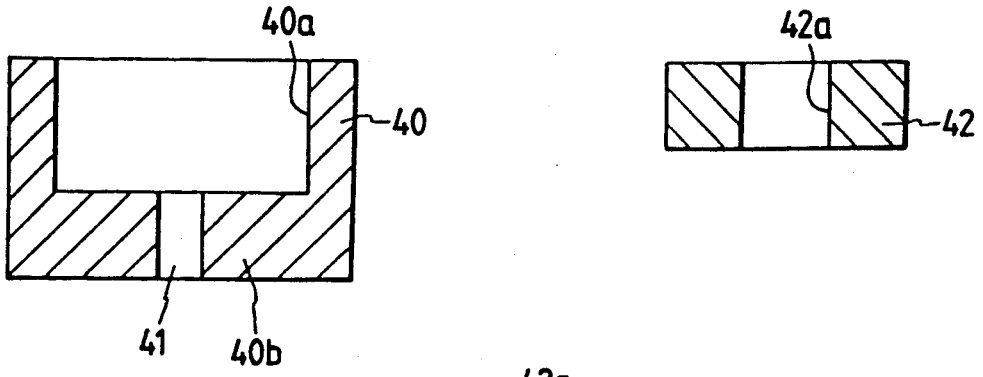
FIGS. 4(I)-4(IV) are schematic cross-sectional view of a second embodiment of a method according to the present invention.
Figure 4:
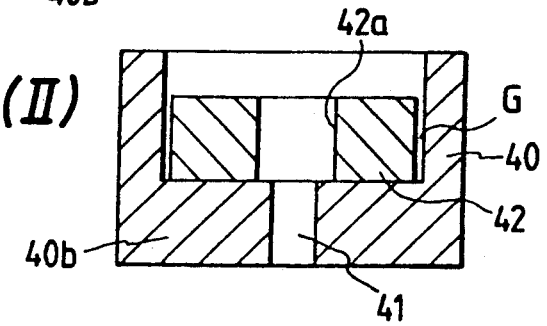
Figure 4:
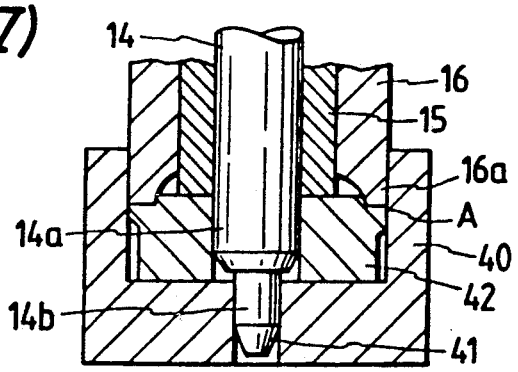
Figure 5A:
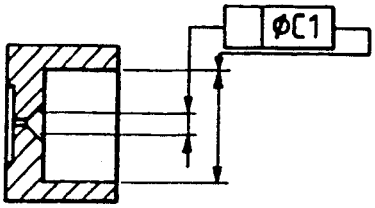
FIG. 5(a) and 5(b) are single components, FIG. 5(*c*) is a combined component, and FIG. 5(*d*) is a comparative graph.
Figure 5B:
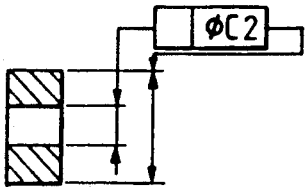
Figure 5C:
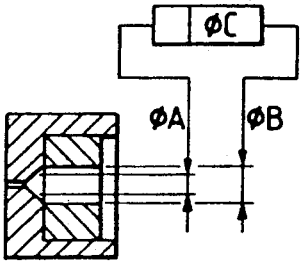
Figure 5D:
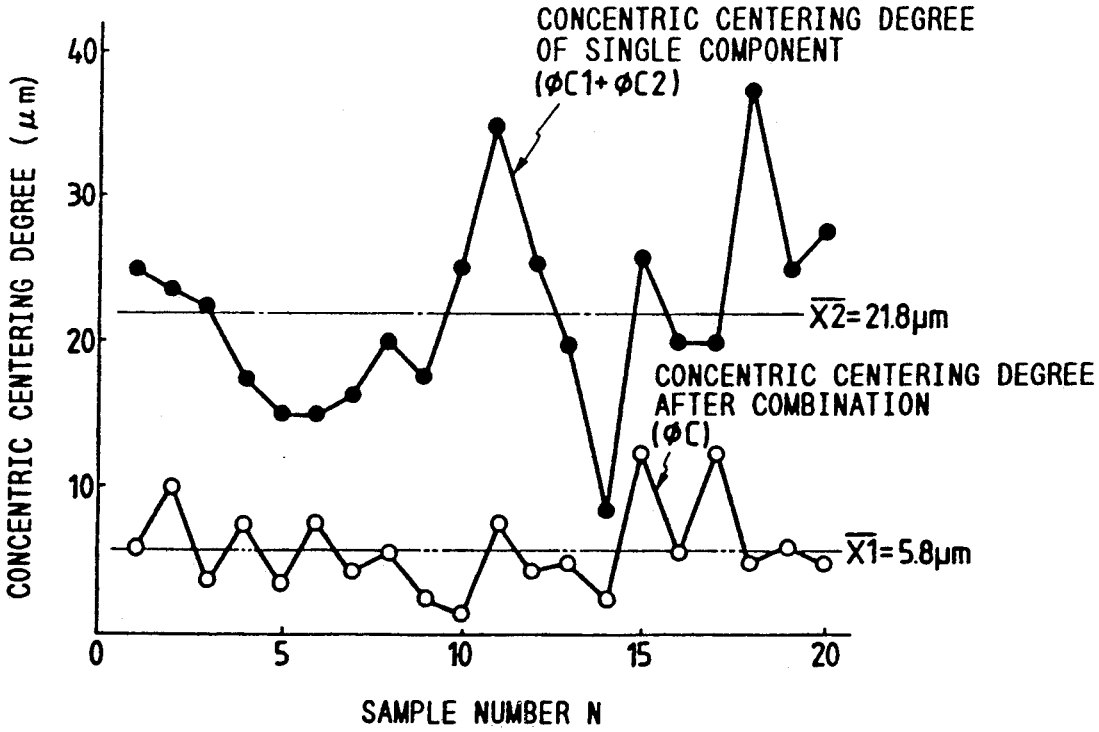

FIG. 4 is a second embodiment according to the present invention, with the temporary positioning and the plastic fluidity combination being carried out using the apparatus of FIG. 2.

In the embodiment of FIG. 4, the diameter of the inner diameter portion 42a of the inner cylindrical component 42 is larger than the diameter of the cylindrical hole of the outer cylindrical component 40. When the outer cylindrical component 40 and the inner cylindrical component 42 are positioned concentrically, as shown in FIGS. 4(I) and 4(II), it is necessary to insert the positioning pin 14 into the cylindrical hole 41 of the outer cylindrical component 40 from the side of the inner diameter portion 42a of the outer cylindrical component 42 and to carry out the centering with the inner diameter portion 42a and the inner cylindrical hole 41.

For the above reasons, in the embodiment of FIG. 4, to insert the positioning pin into the inner diameter portion 42a and the inner cylindrical hole 41, the shape of the positioning pin 41 has a portion 14a of substantially the same diameter as the inner diameter portion 42 and a portion 14b has substantially the same diameter as the inner cylindrical hole 41. A boundary portion is formed between the portions 14a and 14b.

Further, in the embodiment of FIG. 4, the tip end 14' of the positioning pin 14 is formed with a tapering shape serving as an insertion guiding face.

Figure 7:
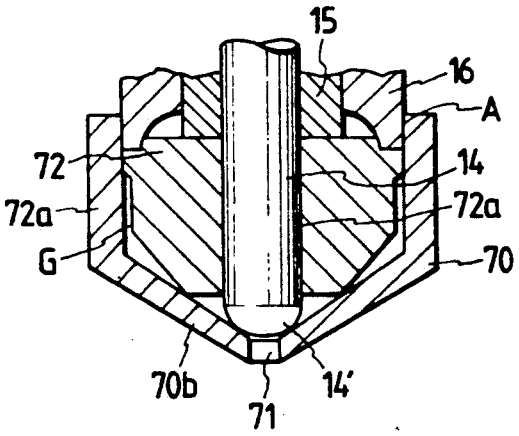
FIG. 7 is a cross-sectional view of a third embodiment according to the present invention.

In the embodiment of FIG. 7, a tip inner bottom face 70b of the outer cylindrical component 70 is formed with a tapering shape adapted to contact a tapering face of an inner cylindrical component 72. A hole 72b, formed at the center of the inner cylindrical component 72 and the tapering inner bottom face 70b, formed at the center of the outer cylindrical component 70, are positioned concentrically, and, subsequently, the combination or joining is carried out by plastic fluidity.

Namely, in the embodiment of FIG. 7, when the inner cylindrical component 72 is fitted to the inner diameter portion 70a of the outer cylindrical component 70 with the clearance or gap G, one end of the inner cylindrical component 72 contacts the tapering bottom face of the outer cylindrical component 70.

In this contact state, in the hole 72a of the inner cylindrical component 72, the pin tip end 14' of the positioning pin 14 is pushed until it contacts the tapering inner bottom face 70b of the outer cylindrical component 70. Accordingly, the temporary positioning is carried out so as to concentrically position the outer cylindrical component 70 and the inner cylindrical component 72.

If the outer cylindrical component 70 is a nozzle and the inner cylindrical component 72 is a valve guide member, Fe-Cr-C (hardness $HR_C$ 60) is used as the material for the outer cylindrical component 70 and Fe-Mi (hardness $HR_B$ 80) is used as the material for the inner cylindrical component 72.

As stated above, the material of the inner cylindrical component 72 is softer than that of the outer cylindrical component 70. Upon a centering, when one end of the outer diameter of the inner cylindrical component 72 is out of centering and contacts the tapering inner bottom face 70b of the outer cylindrical component 70, centering is carried out using the positioning pin 14.

When one end of the outer diameter of the inner cylindrical component 72 is deformed partially against the tapering inner bottom face 70b of the outer cylindrical component 70, the clearance or gap G can absorb any off centering.

After that, the mechanical and local pushing pressure is applied at the vicinity of the fitting portion A using the punch 16, whereby the concentric combination of joining of the inner cylindrical component and the outer cylindrical component is carried out.

As stated above, according to the present invention, when the inner cylindrical component is combined or joined to an outer cylindrical component having the bottom portion, the following method is employed. The positioning pin and the punch operate from the same direction, and the punch is moved and guided along the outer peripheral portion of the positioning pin. Accordingly, with no disturbance by the bottom portion, a good concentric combination of joining of these components can be carried out by plastic fluidity.

Accordingly, the positioning accuracy for the components can be improved. Furthermore, it is possible to carrying out, in a short time period, an automatic loading of the outer cylindrical component and the inner cylindrical component using a press and excellent mass productivity can be obtained. Also, the reliability of the product can be improved because of the elimination of the disadvantages resulting from the presence of the ferrite powder in conventional threaded couplings.

We claim:

1. A method of concentrically assembling an inner cylindrical component having a hole at a central portion thereof and an outer cylindrical component having a bottom portion, the method comprising the steps of:

disposing said inner cylindrical component on said bottom portion of said outer cylindrical component with a clearance formed between an outer diameter portion of said inner cylindrical component and an inner diameter portion of said outer cylindrical component, inserting a guiding pin into said hole of said inner cylindrical component and engaging a tip end of said guiding pin with said bottom portion of said outer cylindrical component for concentrically positioning said inner cylindrical component and said outer cylindrical component, applying a local and vertically directed pressure on an outer peripheral portion of the concentrically positioned inner cylindrical component so as to extend the outer peripheral portion of said inner cylindrical component in a direction of the inner diameter portion of the outer cylindrical portion due to a plastic deformation of material of the outer peripheral portion of said inner cylindrical component so as to join said inner cylindrical component to said outer cylindrical component, whereby said inner cylindrical component and said outer cylindrical component are mutually combined, and withdrawing said guiding pin from the hole of said inner cylindrical component.

2. The method according to claim 1, wherein said tip end has a rounded shape, and said bottom portion of said outer cylindrical component includes a tapering hole at a central portion thereof, sand wherein said step of inserting includes inserting said guiding pin into said tapering hole.

3. A method for concentrically assembling an outer cylindrical component having a bottom portion with a tapering hole in a central portion thereof and an inner cylindrical component having a hole in a central portion thereof, the method comprising the steps of:

fitting said inner cylindrical component into said outer cylindrical component with the inner cylindrical component being disposed on said bottom portion of said outer cylindrical component and with a clearance between an inner diameter portion of said outer cylindrical component and an outer diameter portion of said inner cylindrical component;

inserting a guiding pin having a diameter substantially the same as the diameter of said hole of said inner cylindrical component and having an inserting guiding face at an end tip thereof into said hole of said inner cylindrical component so that said end tip contacts said tapering hole of said outer cylindrical component for temporarily concentrically positioning said hole of said inner cylindrical component and said tapering hole of said outer cylindrical component; and moving and guiding a punch in an insertion direction of said guiding pin into said hole in said inner cylindrical component and said tapering hole of said outer cylindrical component, along an outer peripheral portion of said guiding pin so that said punch presses a portion of said inner cylindrical component to cause a local plastic deformation whereby said inner cylindrical component and said outer cylindrical component are mutually joined due to the force of said plastic deformation.

4. A method for concentrically assembling an outer cylindrical component having a bottom portion with a hole provided in a central portion thereof and an inner cylindrical component having a hole at a central portion thereof, the method comprising the steps of:

fitting said inner cylindrical component into said outer cylindrical component with the inner cylindrical component being disposed on said bottom portion of said outer cylindrical component and with a clearance between an inner diameter portion of said outer cylindrical component and an outer diameter portion of said inner cylindrical component;

inserting a guiding pin, with an inserting guiding face at an end tip thereof into said holes of said inner cylindrical component and said outer cylindrical component so as to temporarily concentrically position said hole of said inner cylindrical component and said hole of said outer cylindrical component; and moving and guiding a punch in an insertion direction of said guiding pin into said hole of said inner cylindrical component and said hole of said outer cylindrical component, along an outer peripheral portion of said guiding pin so that said punch, presses a portion of said inner cylindrical component, to cause a local plastic deformation whereby said inner cylindrical component and said outer cylindrical component are mutually joined due to the force of said plastic deformation.

5. A method for concentrically assembling an outer cylindrical component having a bottom portion with a tapering inner bottom portion and an inner cylindrical component having a hole at a central portion thereof, the method comprising the steps of:

fitting said inner cylindrical component into said outer cylindrical component with the inner cylindrical component being disposed on said tapering inner bottom portion of said outer cylindrical component and with a clearance between an inner diameter portion of said outer cylindrical component and an outer diameter portion of said inner cylindrical component;

inserting a guiding pin, with an inserting guiding face at an end tip thereof into said hole of said inner cylindrical component so that said end tip of said guiding pin contacts said tapering inner bottom portion of said outer cylindrical component, for temporarily concentrically positioning said hole of said inner cylindrical component and said tapering inner bottom portion of said outer cylindrical component; and moving and guiding a punch, in an insertion direction of said guiding pin into said hole of said inner cylindrical component, along an outer peripheral portion of said guiding pin so that said punch presses a portion of said inner cylindrical component to cause a local plastic deformation whereby said inner cylindrical component and said outer cylindrical component are combined together due to the force of said plastic deformation.

6. The method according to claim 5, wherein said inner cylindrical component is made of a material softer than the material of said outer cylindrical component.

7. The method according to either of claims 3 4, 5 or 6, wherein said guiding face has one of a round or a tapered shape.

8. The method according to claim 3 wherein a work holding member and said punch are concentrically disposed about said guiding pin, said guiding pin is operated by a cylinder so as to temporarily concentrically position said inner cylindrical component and said outer cylindrical component, and, when said inner cylindrical component and said outer cylindrical component are mutually joined, an upper face of said inner cylindrical component is pressed by a spring force of said working holding member, and wherein said punch is moved force of a by a force of a ram driven by a main cylinder.

9. A method of assembling a nozzle and a swirler of a fuel injector, said fuel injector comprising a nozzle having a cylindrically shaped nozzle main body and a tapering valve seat at an inner bottom portion thereof, a ring shaped fuel swirler for imparting a swirling force on fuel to be injected by the fuel injector and adapted to be disposed upstream of said valve seat, and a movable valve body cooperable with said valve seat, wherein said swirler includes a guiding hole for guiding said movable valve body for linear reciprocating movement, the method comprising the steps of:

fitting said swirler into an interior of said nozzle main body with a clearance between an inner diameter portion of said nozzle main body and an outer diameter portion of said swirler;

inserting a guiding pin having a diameter substantially the same as the diameter of said guiding hole of said swirler and a guiding face at an end tip thereof into said nozzle main body and through said guiding hole of said swirler such that said guiding pin contacts said valve seat of said nozzle main body for temporarily concentrically positioning said swirler and said valve body seat in said nozzle main body; and moving and guiding a punch in an insertion direction of said guiding pin so that said punch presses a vicinity of a portion of said swirler to cause a local plastic deformation whereby said swirler is combined and fixed to said nozzle main body due to the force of said plastic deformation.

* * * * *